United States Patent [19]

Smith

[11] Patent Number: 4,509,400

[45] Date of Patent: Apr. 9, 1985

[54] SLIDE BAR GUITAR

[76] Inventor: Walter E. Smith, Box 707, Weiser, Id. 83672

[21] Appl. No.: 503,260

[22] Filed: Jun. 10, 1983

[51] Int. Cl.[3] ..... G10D 3/06

[52] U.S. Cl. ..... 84/293; 84/314 R; 84/467

[58] Field of Search ..... 84/293, 314 R, 467, 84/453

[56] References Cited

U.S. PATENT DOCUMENTS 3,398,622 8/1968 Smith ..... 84/314

4,095,506 6/1978 Smith ..... 84/485 R

*Primary Examiner*—Lawrence R. Franklin

*Attorney, Agent, or Firm*—Lyon & Lyon

[57] ABSTRACT

A guitar having strings to be played in conjunction with a manually-held slide bar has an indicator for the proper position of the slide bar along the length of the strings. This position indicator is located between two adjacent strings, the strings on one side of the indicator being tuned to a first major chord and certain of the strings on the other side of the indicator being tuned to a different major chord. The position indicator includes a carrier resiliently mounted at opposite ends and carrying upstanding longitudinally spaced projections, each projection forming a pair of opposed longitudinally spaced abutments engageable by the slide bar at the correct positions along the strings.

1 Claim, 5 Drawing Figures

SLIDE BAR GUITAR

This invention relates to musical instruments and particularly to guitars which are played with a manually-held slide bar. The musician slides the bar along the length of the strings to form various chords when the strings are sounded by means of the pick or by means of the fingers.

The present invention is directed to the solution of two problems relating to this type of guitar. The first problem is that a beginner or a more advanced student has difficulty in placing the slide bar at the correct positions along the length of the strings to produce the desired chords. This problem was addressed in my prior U.S. Pat. No. 4,095,506 granted June 20, 1978. That patent discloses a position indicator mounted along one margin of a set of strings, the position indicator including a plurality of projections to be engaged by the slide bar, the projections being deflectable so that the slide bar may be moved along the strings past a projection, while maintaining contact with the strings.

An important feature of the present invention is to provide an improved form of position indicator, which device is located between two adjacent strings of the guitar.

Another problem confronting a beginner or intermediate student learning to play the slide bar guitar is that certain adjacent strings are tuned to produce a chord of one type, and another group of adjacent strings are tuned to produce a chord of another type. Such tuning of a guitar is disclosed in my prior U.S. Pat. No. 3,398,622 granted Aug. 27, 1968. Tuning of this general type requires that only certain adjacent strings be sounded together, and that certain other adjacent strings not be sounded together. In other words, not all of the strings are to be sounded at the same time. A beginner or intermediate student may find difficulty in sounding the correct group of adjacent strings without also sounding strings in the other group which should remain silent.

The present invention which uses a position indicator between two adjacent strings allows the musician to more accurately control the number of adjacent strings being sounded, so that only the desired chord is produced. The position indicator may thus be used to provide a visual marker between the two separate groups of strings.

Other and more detailed objects and advantages will appear hereinafter.

Figure 1:
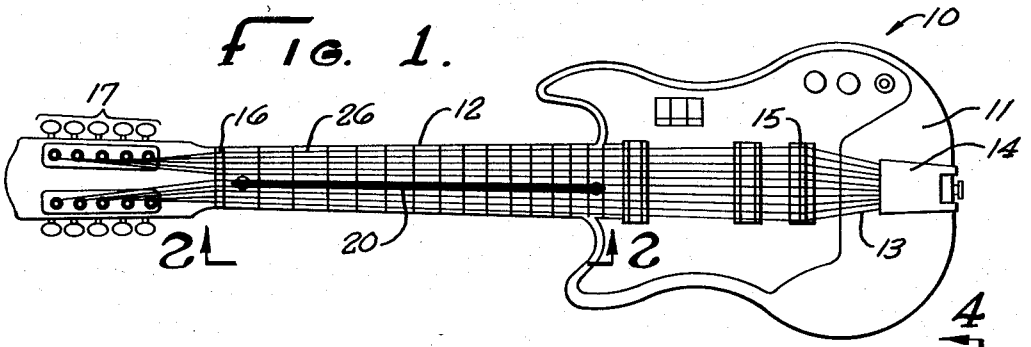
FIG. 1 is a plan view of a guitar constituting a preferred embodiment of this invention.
Figure 4:
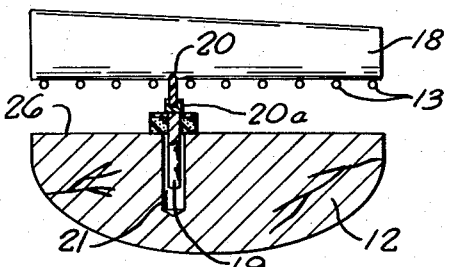
FIG. 4 is a transverse sectional elevation taken substantially on the lines 4—4 as shown on FIG. 2.
Figure 2:
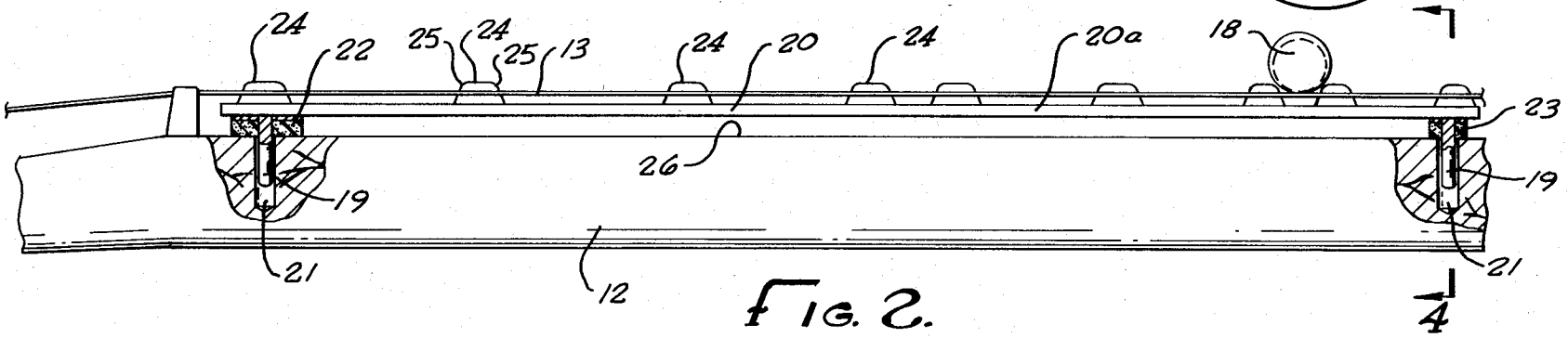
FIG. 2 is an enlarged view taken in the direction of lines 2—2 as shown on FIG. 1, certain parts being shown in section.
Figure 3:
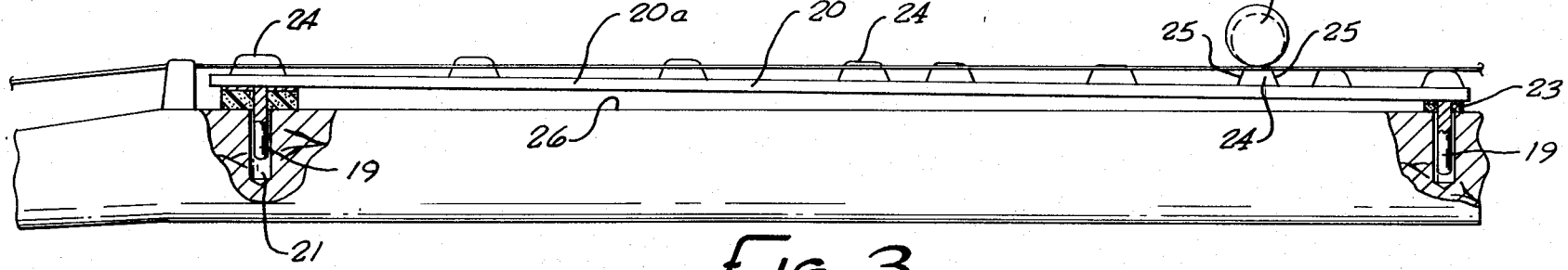
FIG. 3 is a view similar to FIG. 2 showing the slide bar and the position indicator in a depressed state.

Referring to the drawings, the guitar generally designated 10 may have any suitable or desirable form of body 11 and neck 12, preferably of one piece. A plurality of strings 13 extend from a string anchor 14 over the bridge 15, which is mounted on the body 11, and over the nut 16 to the string tightener devices generally designated 17. The strings 13 all lie in the same plane between the bridge 15 and the nut 16. A slide bar 18 is moved manually in longitudinal sliding contact with the strings 13.

In accordance with this invention, a position indicator 20 extends in a longitudinal direction between two of the strings 13. At each end the member 20 carries a post 19,19, each of which is slidably received within a drilled hole 21 in the neck 12. Resilient washers 22,23 encircle the posts to cushion movement of the ends of the position indicator 20 in a direction at right angles to the plane of the strings 13.

Projections 24 are fixed on the carrier 20*a* of position indicator 20 and normally project above the plane of the strings. Each projection 24 has tapered shoulders 25 positioned to be contacted by the slide bar 18 as it slides manually along the length of the strings. The abutments 25 are very helpful to a beginner learning to play the steel guitar. The contact between the slide bar 18 and one of the abutments indicates to the musician that the slide bar is properly positioned with respect to the markings 26 on the upper surface of the neck 12 of the guitar. As the musician manually slides the bar 18 longitudinally of the strings 13, the bar encounters the abutments 24 in sequence. The resilient mountings at opposite ends of the position indicator 20 allow the slide bar 18 to depress the projections 24, without separating the slide bar 18 from the strings 13.

Figure 5:
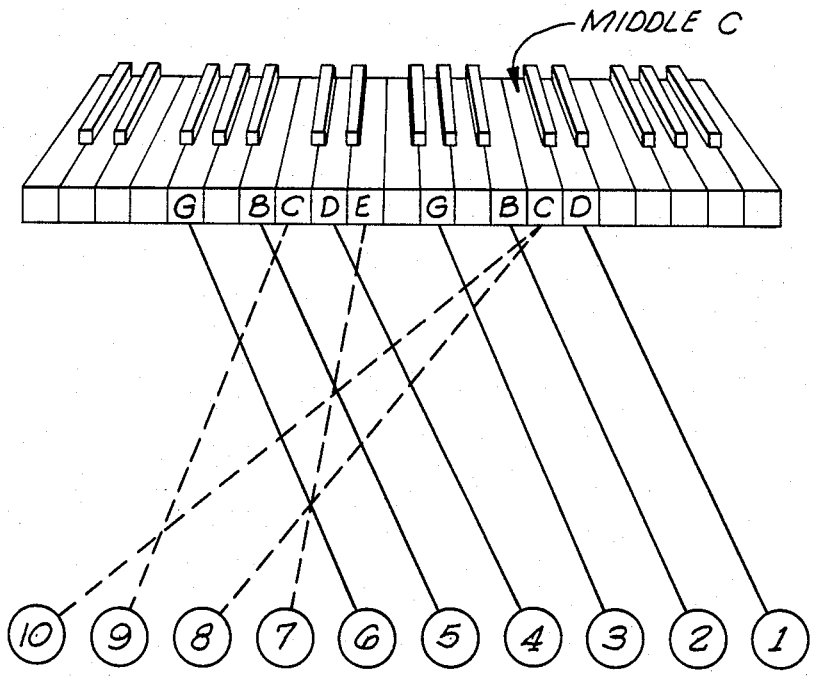
FIG. 5 is a diagram showing how the ten strings of the guitar are tuned with reference to a piano keyboard.

The preferred tuning of the strings of the guitar is indicated in FIG. 5 of the drawings. Each string of the guitar is tuned to the pitch sounded by one of the keys of a piano, as shown. The following table is illustrative of the desired tone intervals:

| STRING NUMBER | STRING TUNING |
|---|---|
| 10 | Middle C |
| 9 | C, an octave below Middle C |
| 8 | Middle C |
| 7 | E below Middle C |
| 6 | G, an octave below string 3 |
| 5 | B, an octave below string 2 |
| 4 | D below Middle C |
| 3 | G below Middle C |
| 2 | B below Middle C |
| 1 | D above Middle C |

Thus, there are two strings, Nos. 8 and 10, tuned to Middle C and one additional string. No. 9, tuned to the C an octave below. This produces a three-string sound which would otherwise be a single note to carry a melody. The E of the seventh string also makes E minor chords possible, as well as E minor seventh chord with strings 7, 6, 5, 4, 3, 2 and 1.

The position indicator 20 provides a visual mechanism which raises and lowers as the slide bar 20 moves over it.

String 10 is used for notes played rapidly, one after another, using a flat pick on the steel guitar. These notes are played as a single note melody with the resulting weak sound of single strings. But with the tuning shown above, strings 9 and 10 are one octave apart, therefore string 9 can always be struck at the same time with string 10 for a strong "lead" melody. String 10 can also be struck with 9 and 8 for a three-not melody. The weak single string sound of a conventional steel guitar is eliminated, unless it is desired for certain phrasing, which can be played on the first, second or third strings.

Having fully described my invention, it is to be understood that I am not to be limited to the details herein set forth but that my invention is of the full scope of the appended claims.

I claim:

1. In a stringed musical instrument having a set of tensioned strings occupying a common plane overlying the instrument and adapted to be played in conjunction with a manually-held slide bar, a position indicator comprising: a carrier extending longitudinally of the tensioned strings and having a series of longitudinally spaced projections extending above said common plane and between the same two strings, each projection forming a pair of opposed longitudinally spaced abutments engageable by said slide bar during longitudinal movement thereof, such movement serving to place the slide bar in preselected locations with respect to said strings, certain of the strings on one side of the position indicator being tuned to produce a first major chord when sounded together, and certain of the strings on the other side of the position indicator being tuned to produce a second major chord when sounded together, resilient means yieldably supporting the carrier and projections to enable the slide bar to depress the projections in sequence to an inoperative position against the action of said resilient means.

* * * * *